US006881458B2

(12) United States Patent
Ludwig et al.

(10) Patent No.: US 6,881,458 B2
(45) Date of Patent: Apr. 19, 2005

(54) INK JET RECEPTIVE COATING

(75) Inventors: Bret W. Ludwig, Oakdale, MN (US); Jeffrey O. Emslander, Afton, MN (US); Caroline M. Ylitalo, Stillwater, MN (US); Oh Sang Woo, Woodbury, MN (US); Jennifer L. Lee, Eagan, MN (US); Richard L. Severance, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 146 days.

(21) Appl. No.: 10/328,564

(22) Filed: Dec. 23, 2002

(65) Prior Publication Data

US 2003/0224150 A1 Dec. 4, 2003

Related U.S. Application Data

(63) Continuation-in-part of application No. 10/162,540, filed on Jun. 3, 2002.

(51) Int. Cl.[7] ..... B41M 5/40

(52) U.S. Cl. ..... 428/32.17; 428/32.26; 428/32.38

(58) Field of Search ..... 428/32.17, 32.26, 428/32.38

(56) References Cited

U.S. PATENT DOCUMENTS

| | | | | |
|---|---|---|---|---|
| 5,102,737 A | | 4/1992 | Josephy et al. | |
| 5,215,814 A | * | 6/1993 | Gager et al. | 428/331 |
| 5,270,368 A | | 12/1993 | Lent et al. | |
| 5,424,355 A | | 6/1995 | Uemae et al. | |
| 5,472,757 A | | 12/1995 | Ogawa et al. | |
| 5,478,631 A | | 12/1995 | Kawano et al. | |
| 5,514,441 A | | 5/1996 | Pohto et al. | |
| 5,610,215 A | | 3/1997 | Nonweiler et al. | |
| 5,645,899 A | | 7/1997 | Unterberger | |
| 5,804,301 A | | 9/1998 | Curatolo | |
| 5,837,351 A | | 11/1998 | Chernovitz et al. | |
| 5,882,388 A | | 3/1999 | Adair et al. | |
| 5,908,495 A | | 6/1999 | Nohr et al. | |
| 5,981,113 A | | 11/1999 | Christian | |
| 5,998,534 A | | 12/1999 | Tang et al. | |
| 6,054,208 A | | 4/2000 | Rega et al. | |
| 6,114,406 A | | 9/2000 | Caiger et al. | |
| 6,130,308 A | | 10/2000 | Rink et al. | |
| 6,228,555 B1 | * | 5/2001 | Hoffend et al. | 430/200 |
| 6,238,804 B1 | * | 5/2001 | Atherton et al. | 428/32.1 |
| 6,316,120 B1 | * | 11/2001 | Emslander | 428/522 |
| 6,589,636 B1 | * | 7/2003 | Emslander et al. | 428/343 |
| 6,720,042 B1 | * | 4/2004 | Ylitalo et al. | 428/32.26 |
| 2003/0021961 A1 | | 1/2003 | Ylitalo et al. | |
| 2003/0054139 A1 | * | 3/2003 | Ylitalo et al. | 428/195 |
| 2003/0180541 A1 | | 9/2003 | Naik et al. | |
| 2003/0224128 A1 | * | 12/2003 | Ylitalo et al. | 428/32.1 |
| 2004/0048073 A1 | | 3/2004 | Bacon, Jr. | |

FOREIGN PATENT DOCUMENTS

| | | |
|---|---|---|
| EP | 0569003 | 11/1993 |
| EP | 0 615 788 | 9/1994 |
| EP | 0 938 979 | 9/1999 |
| EP | 0 952 005 | 10/1999 |
| FR | 2681072 | 3/1993 |
| JP | 61132377 | 6/1986 |
| WO | WO 97/18090 | 5/1997 |
| WO | WO 97/47480 | 12/1997 |
| WO | WO 98/04418 | 2/1998 |
| WO | WO 99/06489 | 2/1999 |
| WO | WO 99/29788 | 6/1999 |
| WO | WO 99/64249 | 12/1999 |
| WO | WO 00/01536 | 1/2000 |
| WO | WO 00/41890 | 7/2000 |
| WO | WO 00/47422 | 8/2000 |
| WO | WO 00/52532 | 9/2000 |
| WO | WO 02/21167 | 3/2002 |
| WO | WO 02/31016 | 4/2002 |
| WO | WO 02/062894 | 8/2002 |
| WO | WO 02/070272 | 9/2002 |
| WO | WO 03/089963 | 10/2003 |

OTHER PUBLICATIONS

"Practical Consideration for Using UV Reactive Inks in Piezo DOD Printheads", 1999 International Conference on Digital Printing Techniques, Richard J. Baker, 5 pages.

NeoRez R–972 NeoResins Technical Information, Aug. 2000.

Avery® SEM™ 1005 Easy Apply Product Data Sheet Feb. 9, 2002.

NeoRez R–966 NeoResins Technical Information, Dec. 2001.

NeoRez R–9679 NeoResins Technical Information, Dec. 2001.

NeoRez R–650 NeoResins Technical Information, Nov. 2001.

NeoRez R–9637 NeoResins Technical Information, Dec. 2002.

NeoCryl A–612 NeoResins Technical Information, Aug. 2000.

NeoRez R–600 NeoResins Technical Information.

NeoRez R–960 NeoResins Technical Information, Dec. 2001.

* cited by examiner

*Primary Examiner*—B. Shewareged
(74) *Attorney, Agent, or Firm*—Carolyn A. Fischer

(57) ABSTRACT

The invention relates to articles comprising a substrate comprising an ink receptive layer and an ink-jet printed image as well as methods of ink jet printing. The ink receptive layer comprises certain urethane-containing polymers and blends.

21 Claims, No Drawings

INK JET RECEPTIVE COATING

RELATED APPLICATIONS

This application is a continuation-in-part of U.S. patent application Ser. No. 10/162,540 filed Jun. 3, 2002.

FIELD OF THE INVENTION

The invention relates to articles comprising a substrate comprising an ink receptive layer and an ink-jet printed image as well as methods of ink jet printing. The ink receptive layer comprises certain urethane-containing polymers and blends.

BACKGROUND OF THE INVENTION

A variety of print methods have been employed for imaging various sheet materials. Commonly employed print methods include gravure, offset, flexographic, lithographic, electrographic, electrophotographic (including laser printing and xerography), ion deposition (also referred to as electron beam imaging [EBI]), magnetographics, ink jet printing, screen-printing and thermal mass transfer. More detailed information concerning such methods is available in standard printing textbooks.

One of ordinary skill in the art appreciates the differences in these various print methods and recognizes that a combination of ink and receiving substrate that results in high image quality in one printing method often exhibits an entirely different image quality with another print method. For example, in contact printing methods such as screen-printing, a blade forces the ink to advance and wet the receiving substrate. Image defects are typically due to a subsequent recession of the ink contact angle with the substrate. In the case of non-contact printing methods such as ink jet printing, the individual ink drops are merely deposited on the surface. In order to achieve good image quality, the ink drops need to spread, join together, and form a substantially uniform, leveled film. This process requires a low advancing contact angle between the ink and the substrate. For any given ink/substrate combination, the advancing contact angle is typically significantly greater than the receding contact angle. Accordingly, ink/substrate combinations that result in good image quality when printed with contact methods such as screen printing, often exhibit insufficient wetting when imaged with non-contact printing methods such as ink jet printing. Insufficient wetting results in low radial diffusion of the individual ink drops on the surface of the substrate (also referred to as "dot gain"), low color density, and banding effects (e.g. gaps between rows of drops).

Another important difference between screen-printing and ink jet printing is the physical properties of the ink. Screen printing ink compositions typically contain over 40% solids and have a viscosity of at least two orders of magnitude greater than the viscosity of ink jet printing inks. It is not generally feasible to dilute a screen printing ink to make it suitable for ink jet printing. The addition of large amounts of low viscosity diluents drastically deteriorates the ink performance and properties, particularly the durability. Further, the polymers employed in screen printing inks are typically high in molecular weight and exhibit significant elasticity. In contrast, ink jet ink compositions are typically Newtonian.

Ink jet printing is emerging as the digital printing method of choice due to its good resolution, flexibility, high speed, and affordability. Ink jet printers operate by ejecting, onto a receiving substrate, controlled patterns of closely spaced and sometimes overlapping ink droplets. By selectively regulating the pattern of ink droplets, ink jet printers can produce a wide variety of printed features, including text, graphics, holograms, and the like. The inks most commonly used in ink jet printers are water-based or solvent-based inks that typically contain about 90% organic and/or aqueous solvents. Water-based inks typically require porous substrates or substrates with special coatings that absorb water.

One problem, however, with ink jet inks is that ink compositions do not uniformly adhere to all substrates. Accordingly, the ink composition is typically modified for optimized adhesion on the substrate of interest. Further, good wetting and flow onto various substrates is controlled by the ink/substrate interaction. Preferably, the interaction results in a sufficiently low advancing contact angle of the ink on the substrate, as previously described. Accordingly, the image quality (e.g. color density and dot gain) of the same ink composition tends to vary depending on the substrate being printed.

Various approaches have been taken to improve image quality of water-based ink jet inks. For example, U.S. Pat. No. 4,781,985 relates to an ink jet transparency, which exhibits the ability to maintain the edge acuity of ink patterns or blocks of the transparency. The transparency comprises a coating thereon which includes a specific fluorosurfactant. Ink dry times are improved upon utilizing an emulsion of a water insoluble polymer and a hydrophilic polymer as the coating on the transparency. The addition of a water insoluble polymer prevents film tackiness during handling, and by reducing water receptivity slightly, allows the ink droplets to spread before the ink solvent vehicle absorption takes place.

WO 02/062894 A1 describes a coating composition comprising (a) at least one binder and (b) at least one filler having a surface areas of at least about 1 $m^2/g$ and wherein the topcoat derived from the coating composition is printable with a UV curable ink-jet ink. Also described is an article with an ink receptive printing layer, comprising a substrate having a topcoat, wherein the topcoat is printable with UV curable ink-jet inks.

EP 0 615 788 A1 (Watkins) describes a method for forming clear coats on retroreflective articles utilizing an aqueous coating composition comprising water, water-borne dispersion of polyurethane, and cross-linker, and optionally acrylic emulsion. Also described are retroreflective articles formed according to the method and a preferred liquid coating composition for use in the method and in making the articles.

SUMMARY OF THE INVENTION

The present inventors have found that certain urethane-containing compositions exhibit a proper balance of ink uptake in combination with good color density (i.e. dot gain) even though such compositions are substantially free of filler.

DETAILED DESCRIPTION OF THE PREFERRED EMBODIMENTS

In the present invention the ink receptive layer is derived from and thus comprises certain urethane-containing polymeric resins. As used herein "base polymer" refers to a single urethane-containing copolymer such as a urethane acrylic copolymer optionally blended with a polyurethane polymer or an acrylic polymer, a blend of at least one polyurethane polymer and at least one acrylic polymer, a blend of at least two polyurethane polymers, and mixtures thereof. Further, the urethane-containing base polymer may optionally be crosslinked. The blend of polymers may form a homogeneous mixture or may be multiphase, exhibiting two or more distinct peaks when analyzed via differential scanning calorimetry (DSC). Further, the ink receptive composition may comprise an interpenetrating network of the base polymer in an insoluble matrix or vice-versa.

In order to achieve good image quality during ink jet printing the printed ink drops must spread to within an acceptable range in order to provide complete solid fill of the image. The present applicants have found that the use of an acrylic polymer alone as an ink receptive layer tends to result in the ink drops not spreading enough leaving unfilled background areas that contribute to reduced color density and banding defects (i.e. gaps between the rows of ink drops). This is surmised due to the good solvent uptake of acrylic polymers. On the other hand, the use of a polyurethane polymer alone tends to result in the ink drops spreading too much resulting in loss of resolution, poor edge acuity, and inter-color bleed occurs in the case of multi-color graphics. This is surmised due to insufficient solvent uptake of polyurethane polymers. The inventive ink receptive layer described herein exhibits a good balance of ink uptake and color density even though the composition is substantially free of fillers as well as the composition being substantially free of components that are soluble in the solvent of the ink.

The ink receptive coating layer is typically initially swelled immediately after application of the ink jetted ink. However, after drying (i.e. evaporation of the solvent) the thickness of the ink receptive coating layer is substantially the same. Although the ink receptive coating absorbs the solvent portion of the ink, the binder and colorant of the ink composition tends to remain on the surface of the ink receptive coating layer. Accordingly, at least the urethane portion of the ink receptive coating layer is substantially insoluble in the ink composition (e.g. solvent of the ink).

The image quality can be quantitatively expressed with reference to color density and with regard to the final ink dot diameter, as described in U.S. Pat. No. 4,914,451. The black color density is preferably at least about 1.5. The final ink dot diameter on the substrate is preferably greater than $[(2)^{1/2}]$/dpi but no more than 2/dpi, wherein dpi is the print resolution in dots per linear inch.

In a first aspect, the ink receptive coating of the invention comprises a urethane containing copolymer. As used herein "copolymer" refers to a polymer having urethane segments and segments of at least one polymeric material that is different than a urethane. Preferred urethane acrylic copolymers include those commercially available from Neoresins Inc., Wilmington, Mass., such as under the trade designation "NeoPac R-9000". The urethane acrylic copolymer may be employed alone or optionally in combination with at least one polyurethane polymer or at least one acrylic polymer. For use on polyolefin films, it is preferred to employ the NeoPac R-9000 alone or blended with an acrylic resin such as "NeoCryl A-612" at a ratio of about 4:1.

In another aspect of the invention, the ink receptive coatings are preferably derived from a blend comprising at least two polyurethane polymers or at least one polyurethane polymer and at least one acrylic polymer. Aliphatic polyurethanes typically exhibit greater durability, resistance to yellowing, etc. and thus are preferred. Illustrative examples of useful aqueous polyurethane dispersions include those commercially available from Neoresins, Wilmington, Mass. under the trade designations "NeoRez R-960", "NeoRez R-966", "NeoRez R-9637", "NeoRez R-600", "NeoRez R-650", "NeoRez R-989" and "NeoRez R-9679".

The concentration of polyurethane in the ink receptive coating generally ranges from about 40 wt-% to about 90 wt-% solids, i.e. the weight of the polyurethane after evaporation of water and/or solvent of the polyurethane emulsion or dispersion relative to the content of the other solid materials in the formulation. Preferably, the amount of polyurethane in the polyurethane/acrylic blend is at least about 50 wt-% and more preferably at least about 60 wt-%.

With regard to ink receptive coatings further comprising at least one acrylic polymer, the amount of acrylic polymer generally ranges from about 10 wt-% to about 60 wt-% solids. Various acrylic resins are known. A particularly suitable water-based acrylic emulsion is commercially available from Neoresins, Wilmington Mass. under the trade designations "NeoCryl A-612" (reported to have a Konig Hardness of 75 at 144 hours).

Preferred blends comprising a polyurethane polymer and an acrylic polymer include mixtures of NeoRez R-960 and/or NeoRez R-966 (Sward Hardness=30) with Neocryl A-612 (acrylic) wherein the proportion of polyurethane to acrylic is about 2:1. NeoRez R-9679 is also suitable in place of NeoRez R-960 at slightly lower concentrations of polyurethane (e.g. weight ratio of 55/45). The blends just described are particularly preferred for poly(vinyl chloride)-containing films. Another preferred composition, particularly for embodiments wherein the composition is coated onto a polyolefin-containing film comprises NeoRez R-600 and NeoCryl A-612 at a ratio of 4:1.

A preferred composition comprising a blend of at least two polyurethane polymers include a mixture of NeoRez R-650 (report to have a MFFT of <0° C.) and NeoRez R-989 at a ratio of 9:1. The NeoRez R989 is available from NeoResins in Japan.

After testing the ink-jet receptivity of various compositions, it became evident that the preferred polyurethanes share some common physical properties as set forth in Table I as follows:

TABLE I

| | NeoRez R-960 | NeoRez R-9637 | NeoRez R-9679 | NeoRez R-966 |
|---|---|---|---|---|
| Pencil Hardness | 3H | 4H | 4H | 3H |
| Taber Abrasion mg loss per 1000 cycles, CS-17 wheel, 1000 g load | 22 | 21 | | 16 |
| Impact Resistance At 30° F., in-lb | 160 | 160 | 160 | 160 |
| Free Film Properties | | | | |
| 100% modulus, psi | 4000 | 7000 | 3800 | |
| tensile strength, psi | 6500 | 8000 | 3800 | 6000 |
| elongation, % | 200 | 200 | 350 | 225 |

The preferred water-borne urethane dispersions are described in the literature published by the supplier as being abrasion resistant, chemical resistance in combination with having impact resistance and flexibility. Preferred urethane polymers for use in combination with an acrylic polymer or a second urethane polymer have an impact resistance of at least 100 in-lb, and preferably of at least 150 in-lb. Further, the elongation is at least 100%, preferably at least 150%, and more preferably at least 200%. The tensile strength and 100% modulus is preferably at least 3000 psi.

The second urethane polymer or acrylic polymer typically has different physical properties than the first urethane polymer. In some embodiments, the second urethane is considerably more flexible, having an elongation of at least 400% or 1.5 times higher that the first urethane polymer. In other embodiments that second polymer (e.g. acrylic) is considerably harder than the first urethane polymer, having a measurable Konig Hardness or Sward Hardness. Preferred, second urethane polymers or acrylic polymers have a Konig Hardness of at least 20 for a 30% solids 3 mil wet film on glass or a measurable Sward hardness, i.e. of at least 3.

Although, the ink receptive coating compositions for use in the invention may be solvent-based, water-based ink receptive coating compositions are preferred. Water-based emulsions and dispersions are advantageous to reduce solvent emissions by employing ink receptive compositions that are substantially free of volatile organic solvents. Upon evaporation of the solvent or water, the coating typically forms a continuous film layer. The ink receptive coating compositions described herein are typically unreactive with the ink composition.

The kind and amount of polymer(s) selected for use as the base polymer of the ink receptive coating composition are chosen such that the coating composition exhibits a suitable viscosity for use in the intended application equipment. For example, if the ink receptive composition is intended to be gravure coated, the kind and amount of base polymer(s) is chosen such that the coating will have a viscosity ranging from about 20 to about 1000 cps. In the case of knife coating and bar coating, however, the viscosity may range as high as 20,000 cps. The viscosity of the coating can be adjusted by dilution, thickening agents, etc. as is known in the art. In general, higher molecular weight base polymer tends to produce the best image resolution.

The coating composition may optionally contain one or more crosslinkers to increase the outdoor durability and chemical resistance. Illustrative examples thereof include melamine or aziridine, or blends thereof. Typically, the concentration of crosslinker is relatively low, ranging form about 0.2 wt-% to about 4 wt-%. Whereas low concentrations of crosslinker can improve the outdoor durability, at too high of concentrations the coating layers exhibit insufficient ink uptake. Due to the low level of crosslinking agent, the compositions described herein are not stain resistant as described in WO 02/070272.

The base polymer of the coating typically has a solubility parameter, molecular weight, and glass transition temperature (Tg) within a specified range. As used herein, "molecular weight" refers to weight average molecular weight (Mw), unless specified otherwise.

The solubility parameter of the base polymer of the ink receptive coating composition as well as the ink composition ink jetted onto the coated substrate may vary, typically ranging from about 7 $(cal/cm^3)^{1/2}$ to about 12 $(cal/cm^3)^{1/2}$. Preferably, the solubility parameter of both the ink and ink receptive coating is at least about 8 $(cal/cm^3)^{1/2}$ and less than about 10 $(cal/cm^3)^{1/2}$. The solubility of various pure materials, such as solvents, polymers, and copolymers as well as mixtures is known. The solubility parameters of such materials are published in various articles and textbooks. In the present invention, the terminology "solubility parameter" refers to the Hildebrand solubility parameter which is a solubility parameter represented by the square root of the cohesive energy density of a material, having units of $(\text{pressure})^{1/2}$, and being equal to $(\Delta H\text{-}RT)^{1/2}/V^{1/2}$ where $\Delta H$ is the molar vaporization enthalpy of the material, R is the universal gas constant, T is the absolute temperature, and V is the molar volume of the solvent. Hildebrand solubility parameters are tabulated for solvents in: Barton, A. F. M., *Handbook of Solubility and Other Cohesion Parameters*, 2nd Ed. CRC Press, Boca Raton, Fla., (1991), for monomers and representative polymers in *Polymer Handbook*, 3rd Ed., J. Brandrup & E. H. Immergut, Eds. John Wiley, NY pp 519–557 (1989), and for many commercially available polymers in Barton, A. F. M., *Handbook of Polymer-Liquid Interaction Parameters and Solubility Parameters*, CRC Press, Boca Raton, Fla., (1990).

The base polymer has a weight average molecular weight (Mw) as measured by Gas Permeation Chromotography (GPC) of greater than about 60,000 g/mole, preferably greater than about 80,000 g/mole, and more preferably greater than about 100,000 g/mole. Water-borne polymeric materials as well as aqueous dispersions and emulsions often contain polymeric materials having a relatively high Mw, ranging from greater than 400,000 to 1,000,000 or more. In the case wherein the base polymer comprises a blend of two or more polymeric species, the Mw of the blend, for purposes of the present invention, refers to the Mw calculated in accordance with the following equation:

$Mw(blend)=\Sigma w_x M_x$; wherein $M_x$ is the weight average molecular weight of each polymeric species and $w_x$ is the weight fraction of such polymeric species with respect to the blend.

Accordingly, in the case of a bimodal blend, the Mw of the blend is typically a median value between the peaks.

In addition to the previously described solubility parameter and Mw, the base polymer of the ink receptive composition of the invention ranges in glass transition temperature (Tg), as measured according to Differential Scanning Colorimetry (DSC) from about 30° C. to about 95° C. and preferably from about 50° C. to about 80° C. Although the polyurethane alone may have a Tg of less than about 30° C., the presence of the higher Tg acrylic polymer ensures that the Tg of the blend is within the specified range. At a Tg of greater than about 95° C., the solvent of the ink generally does not significantly penetrate into the ink receptive layer. In the case of ink receptive coating compositions comprising two or more polymers wherein each has a distinct Tg peak when measured by DSC, the Tg of the blend, for purposes of the present invention, refers to the Tg calculated in accordance with the following equation:

$1/Tg(blend)=\Sigma w_x/Tg_x$; wherein $Tg_x$ is the Tg of each polymeric species and $w_x$ is the weight fraction of such polymeric species with respect to the blend. Tg values in the above equation are measured in degrees Kelvin.

The ink receptive coating composition as well as the ink composition may comprise a variety of optional additives. Such optional additives include one or more flow control agents, photoinitiators, colorants, slip modifiers, thixotropic agents, antifoaming agents, flow or other rheology control agents, waxes, oils, polymeric materials, binders, antioxidants, photoinitiator stabilizers, heat stabilizers, dispersants, gloss agents, fungicides, bactericides, leveling agents, opacifiers, antistatic agents, dispersants, and the like. Surprisingly, however, the compositions described herein exhibit a good balance of ink uptake and color density while being substantially free of filler.

To enhance durability of the imaged substrate, especially in outdoor environments exposed to sunlight, a variety of commercially available stabilizing chemicals can be added optionally to the ink receptive compositions. These stabilizers can be grouped into the following categories: heat stabilizers, UV light stabilizers, and free-radical scavengers.

Ultraviolet light stabilizers can be present in amounts ranging from about 0.1 to about 5 weight percent of the total ink receptive composition or ink. Benzophenone type UV-absorbers are commercially available from BASF Corp., Parsippany, N.J. under the trade designation "Uvinol 400"; Cytec Industries, West Patterson, N.J. under the trade designation "Cyasorb UV1164" and Ciba Specialty Chemicals, Tarrytown, N.Y., under the trade designations "Tinuvin 900", "Tinuvin 123" and "Tinuvin 1130".

Free-radical scavengers can be present in an amount from about 0.05 to about 0.25 weight percent of the total ink receptive composition. Nonlimiting examples of free-radical scavengers include hindered amine light stabilizer (HALS) compounds, hydroxylamines, sterically hindered phenols, and the like.

HALS compounds are commercially available from Ciba Specialty Chemicals under the trade designation "Tinuvin 292" and Cytec Industries under the trade designation "Cyasorb UV-24".

In general, the ink receptive composition is typically substantially free of colorant, particularly when applied to the entire surface of the article. However, the coating may also contain colorants, the colored ink receptive layer being suitable for use as a color layer. Alternatively, uncolored ink receptive coating may be only applied directly beneath the image wherein the ink receptive surface corresponds substantially identically in size and shape to the image.

For retroreflective sheeting, the ink receptive layer as well as the ink composition (with the exception of ink compositions containing opaque colorants such as carbon black, titanium dioxide, or organic black dye) are typically transparent when measured according to ASTM 810 Standard Test Method for Coefficient of Retroreflection of Retroreflective Sheeting. That is, when coated onto retroreflective substrates, the visible light striking the surface of such films is transmitted through to the retroreflective sheeting components. This property makes the articles particularly useful for outdoor signing applications, in particular traffic control signing systems. Further, the dried and/or cured ink receptive composition is substantially non-tacky such that the printed image is resistant to dirt build-up and the like.

Dyes are generally chosen based on their solubility with the base polymer of the ink receptive composition. Suitable dyes include anthraquinone dyes, such as commercially available from Bayer Corp., Coatings and Colorants Division, Pittsburgh Pa. under the trade designation "Macrolex Red GN" and "Macrolex Green 5B" and commercially available from BASF Akt., Ludwigshafen, Germany under the trade designation "Thermoplast Red 334" and "Thermoplast Blue 684"; pyrazolone dyes, such as commercially available from BASF Akt. under the trade designation "Thermoplast Yellow 104"; and perinone dyes, such as commercially available from Bayer Corp. under the trade designation "Macrolex Orange 3G."

In the method of the present invention, a substrate is provided that comprises an ink-receptive surface layer derived from the ink receptive coatings previously described. The ink receptive layer of the substrate is imaged with a non-aqueous, preferably solvent-based or radiation curable peizo ink-jet ink.

"Piezo ink" refers to an ink having a viscosity ranging from about 3 to about 30 centipoise at the printhead operating temperature. Such inks preferably have a viscosity below about 25 centipoise, and more preferably below about 20 centipoise at the desired ink jetting temperature (typically from ambient temperature up to about 65° C.).

Piezo ink jet compositions typically comprise a binder, plasticizer, organic solvent, pigment particles and optional additives such as surfactants (e.g. fluorochemical), anti-foaming agent (e.g. silica and silicone oil), stabilizers, etc. Piezo ink jet compositions characteristically have moderate to low surface tension properties. Preferred formulations have a surface tension in the range of from about 20 mN/m to about 50 mN/m and more preferably in the range of from about 22 mN/m to about 40 mN/m at the printhead operating temperature. Further, piezo ink compositions typically have Newtonian or substantially Newtonian viscosity properties. A Newtonian fluid has a viscosity that is at least substantially independent of shear rate. As used herein, the viscosity of a fluid will be deemed to be substantially independent of shear rate, and hence at least substantially Newtonian, if the fluid has a power law index of 0.95 or greater. The power law index of a fluid is given by the expression $$\eta = m\gamma^{n-1}$$

wherein $\eta$ is the shear viscosity, $\gamma$ is the shear rate in $s^{-1}$, m is a constant, and n is the power law index. The principles of the power law index are further described in C. W. Macosko, *Rheology: Principles, Measurements, and Applications*, ISBN #1-56081-579-5, p. 85.

The peizo inks employed in the method and article of the invention are non-aqueous, meaning that the ink is substantially free of water. In the case of non-aqueous solvent-based inks, the solvent of the piezo ink composition may be a single solvent or a blend of solvents. Suitable solvents include alcohols such as isopropyl alcohol (IPA) or ethanol; ketones such as methyl ethyl ketone (MEK), methyl isobutyl ketone (MIBK), diisobutyl ketone (DIBK); cyclohexanone, or acetone; aromatic hydrocarbons such as toluene; isophorone; butyrolactone; N-methylpyrrolidone; tetrahydrofuran; esters such as lactates, acetates, including propylene glycol monomethyl ether acetate such as commercially available from 3M under the trade designation "3M Scotchcal Thinner CGS10" ("CGS10"), 2-butoxyethyl acetate such as commercially available from 3M under the trade designation "3M Scotchcal Thinner CGS50" ("CGS50"), ethyl-3-ethoxy propionate such as commercially available from 3M under the trade designation "3M Scotchcal Thinner CGS30" ("CGS30"), diethylene glycol ethyl ether acetate (DE acetate), ethylene glycol butyl ether acetate (EB acetate), dipropylene glycol monomethyl ether acetate (DPMA), iso-alkyl esters such as isohexyl acetate, isoheptyl acetate, isooctyl acetate, isononyl acetate, isodecyl acetate, isododecyl acetate, isotridecyl acetate or other iso-alkyl esters; combinations of these and the like.

In general, organic solvents tend to dry more readily and thus are preferred solvents for piezo ink compositions. As used herein, "organic solvent" refers to a liquid having a solubility parameter greater than 7 $(cal/cm^3)^{1/2}$. Further, organic solvents typically have a boiling point of less than 250° C. and a vapor pressure of greater than 5 mm of mercury at 200° F. (93° C.). Highly volatile solvents, such as MEK and acetone, are typically avoided, as such solvents dry too quickly resulting in nozzle clogging at the print heads. Further, highly polar solvents, such as low molecular weight alcohols and glycols, tend to have too high of a solubility parameter for adequate ink uptake.

Radiation curable ink compositions comprise one or more radiation curable monomer(s), oligomer(s), macromonomer (s), polymer(s) or various mixtures of such components. "Radiation curable" refers to functionality directly or indirectly pendant from the backbone that reacts (e.g. crosslinks) upon exposure to a suitable source of curing energy. Suitable radiation crosslinkable groups include epoxy groups, (meth) acrylate groups, olefinic carbon-carbon double bonds, allyloxy groups, alpha-methyl styrene groups, (meth)acrylamide groups, cyanate ester groups, vinyl ethers groups, combinations of these, and the like. Free radically polymerizable groups are typically preferred. Of these, (meth)acryl moieties are most preferred. The term "(meth)acryl", as used herein, encompasses acryl and/or methacryl.

The energy source used for achieving crosslinking of the radiation curable functionality may be actinic (e.g., radiation having a wavelength in the ultraviolet (UV) or visible region of the spectrum), accelerated particles (e.g., electron beam (EB) radiation), thermal (e.g., heat or infrared radiation), or the like with UV and EB being preferred. Suitable sources of actinic radiation include mercury lamps, xenon lamps, carbon arc lamps, tungsten filament lamps, lasers, electron beam energy, sunlight, and the like.

The radiation curable ingredient may be mono-, di-, tri-, tetra- or otherwise multifunctional in terms of radiation curable moieties. The oligomers, macromonomers, and polymers may be straight-chained, branched, and/or cyclic with branched materials tending to have lower viscosity than straight-chain counterparts of comparable molecular weight.

A preferred radiation curable ink composition comprises a radiation curable reactive diluent, one or more oligomers (s), macromonomer(s) and polymer(s), and one or more optional adjuvants. For outdoor applications, polyurethane and acrylic-containing monomer(s), macromonomer(s), oligomer(s) and polymer(s) are preferred. The higher molecular weight species also tend to be readily soluble in reactive diluents.

Examples of commercially available (meth)acrylated urethanes and polyesters include those commercially available from Henkel Corp., Hoboken, N.J. under the trade designation "Photomer"; commercially available from UCB Radcure Inc., Smyrna, Ga. under the trade designation "Ebecryl"; commercially available from Sartomer Co., Exton, Pa. under the trade designation "Sartomer CN"; commercially available from Akcross Chemicals, New Brunswick, N.J. under the trade designation "Actilane"; and commercially available from Morton International, Chicago, Ill. under the trade designation "Uvithane".

Provided that at least one of the ingredients is radiation curable, the radiation curable ink may comprise non-radiation curable ingredients as well. For example, polymers such as polyurethanes, acrylic material, polyesters, polyimides, polyamides, epoxies, polystryene as well as substituted polystyrene containing materials, silicone containing materials, fluorinated materials, combinations thereof, and the like, may be combined with reactive diluents (e.g. monomers).

Suitable piezo inks for use in the invention include ink compositions commercially available from 3M Company ("3M"), St. Paul, Minn. under the trade designations "3M Scotchcal 3700 Series Inks", "3M Scotchcal 1600 Series Inks" "3M Scotchcal 6700 Series Inks" and ink compositions available from Ultraview Inkware of VUTEk, Meredith, N.H. under the trade designation "UltraVu". A preferred piezo ink jet composition is described in U.S. Pat. No. 6,113,679 (Adkins), incorporated herein by reference. Radiation curable inks are commercially available from 3M under the trade designations "3M Scotchcal 5000UV Series Inks" and commercially available from SunJet of Sun Chemicals, For Lee, N.J. under the trade designation "CrystalUFX Series".

The articles of the present invention comprise a substrate comprising an ink receptive layer and an ink-jetted image on the ink receptive layer. As used herein "ink jetted image" and "ink jet printed" both refer to an image created with an ink jet printing process employing a non-aqueous, solvent based or radiation curable piezo ink composition. The image may be text, graphics, coding (e.g. bar coding), etc., being comprised of a single color, multi-colored or being unapparent in the visible light spectrum.

The article comprises a substrate wherein at least a portion of the surface comprises the ink receptive composition forming an ink receptive surface layer. For ease in manufacturing the entire surface of the substrate may comprise the ink receptive composition. A non-aqueous solvent-based or radiation curable ink is applied (e.g. ink jet printed) onto the ink receptive layer and dried. In the simplest construction, the ink receptive coating is disposed directly onto the substrate. In other embodiments, wherein additional coatings are employed, the ink receptive layer is disposed between the substrate and the viewing surface of the article. For example, the article may comprise an additional topcoat or topfilm disposed over the imaged ink receptive layer. Alternatively, the ink receptive coating may be applied to the topfilm. The coated surface may then be reverse imaged and bonded to a second substrate. In preferred embodiments the ink receptive layer, ink composition, as well as the entire article, exhibit good weatherability, being durable for outdoor usage. Preferably, the ink receptive compositions are sufficiently durable such that additional protective layers are not required.

The thickness of the ink receptive layer is preferably at least about 0.2 micron, more preferably at least about 0.5 micron, and most preferably at least about 1 micron. It is typically desirable to employ as little ink receptive coating as needed, the thickness preferably being less than about 25 microns, more preferably less than about 10 microns, and most preferably less than about 5 microns. At too low of an ink receptive layer thickness, the improvement contributed by the ink receptive layer is diminished.

The article or substrate (e.g. film, sheet) has two major surfaces. The first surface, denoted herein as the "viewing surface" comprises the ink receptive composition and the image (e.g. ink jetted image). The opposing surface of the article may also comprise a printed image forming a "second viewing surface". In such embodiments, the second viewing surface may also comprise an ink receptive composition and an image. Alternatively, and most common however, the opposing surface is a non-viewing surface that typically comprises a pressure sensitive adhesive protected by a release liner. The release liner is subsequently removed and the imaged substrate (e.g. sheeting, film) is adhered to a target surface such as a sign backing, billboard, automobile, truck, airplane, building, awning, window, floor, etc.

The ink receptive composition is suitable for use on a wide variety of substrates. Although the ink receptive composition could be applied to substrates such as paper, upon exposure to rain, paper typically deteriorates and thus is not sufficiently durable for outdoor usage. Similarly, the ink receptive composition could also be applied to a substrate or substrate layer having a low softening point, for example less than about 100° F. (38° C.). However, this construction would also exhibit poor durability. Accordingly, the substrate typically has a softening point greater than about 120° F. (49° C.), preferably greater than about 140° F. (60° C.), more preferably greater than about 160° F. (71° C.), even more preferably greater than about 180° F. (82° C.), and most preferably greater than about 200° F. (93° C.). Other materials that are typically unsuitable for use as the substrate include materials that corrode (e.g. oxidize) or dissolve in the presence of water such as various metals, metallic oxides, and salts.

Suitable materials for use as the substrate in the article of the invention include various sheets, preferably comprised of thermoplastic or thermosetting polymeric materials, such as films. Further, the ink receptive composition is particularly advantageous for low surface energy substrates. "Low surface energy" refers to materials having a surface tension of less than about 50 dynes/cm (also equivalent to 50 milliNewtons/meter). The polymeric substrates are typically nonporous. However, microporous, apertured, as well as materials further comprising water-absorbing particles such as silica and/or super-absorbent polymers, may also be employed provided the substrate does not deteriorate or delaminate upon expose to water and temperature extremes, as previously described. Other suitable substrates include woven and nonwoven fabrics, particularly those comprised of synthetic fibers such as polyester, nylon, and polyolefins.

The substrates as well as the imaged article (e.g. sheets, films, polymeric materials) for use in the invention may be clear, translucent, or opaque. Further, the substrate and imaged article may be colorless, comprise a solid color or comprise a pattern of colors. Additionally, the substrate and imaged articles (e.g. films) may be transmissive, reflective, or retroreflective.

Representative examples of polymeric materials (e.g. sheet, films) for use as the substrate in the invention include single and multi-layer constructions of acrylic-containing films (e.g. poly(methyl) methacrylate [PMMA]), poly(vinyl chloride)-containing films, (e.g. reinforced vinyl, vinyl/acrylic blends), poly(vinyl fluoride) containing films, urethane-containing films, melamine-containing films, polyvinyl butyral-containing films, polyolefin-containing films, polyester-containing films (e.g. polyethylene terephthalate) and polycarbonate-containing films. Further, the substrate may comprise copolymers of such polymeric species. Other particular films for use as the substrate in the invention include multi-layered films having an image reception layer comprising an acid- or acid/acrylate modified ethylene vinyl acetate resin, as disclosed in U.S. Pat. No. 5,721,086 (Emslander et al.). The image reception layer comprises a polymer comprising at least two monoethylenically unsaturated monomeric units, wherein one monomeric unit comprises a substituted alkene where each branch comprises from 0 to about 8 carbon atoms and wherein one other monomeric unit comprises a (meth)acrylic acid ester of a nontertiary alkyl alcohol in which the alkyl group contains from 1 to about 12 carbon atoms and can include heteroatoms in the alkyl chain and in which the alcohol can be linear, branched, or cyclic in nature. A preferred film for increased tear resistance includes multi-layer polyester/copolyester films such as those described in U.S. Pat. Nos. 5,591,530 and 5,422,189.

Depending of the choice of polymeric material and thickness of the substrate, the substrate (e.g. sheets, films) may be rigid or flexible. Preferred ink receptive compositions and ink compositions are preferably at least as flexible as the substrate. "Flexible" refers to the physical property wherein imaged ink receptive layer having a thickness of 50 microns can be creased at 25° C. without any visible cracks in the imaged ink receptive layer.

Commercially available films include a multitude of films typically used for signage and commercial graphic uses such as available from 3M under the trade designations "Panaflex", "Nomad", "Scotchcal", "Scotchlite", "Controltac", and "Controltac Plus".

The ink receptive compositions are prepared by mixing together the desired ingredients using any suitable technique. For example, in a one step approach, all of the ingredients are combined and blended, stirred, milled, or otherwise mixed to form a homogeneous composition. As another alternative, some of the components may be blended together in a first step. Then, in one or more additional steps, the remaining constituents of the component if any, and one or more additives may be incorporated into the composition via blending, milling, or other mixing technique.

During the manufacture of the articles of the invention, the ink receptive composition is applied to a surface of the substrate. The ink receptive coating may be applied with any suitable coating technique including screen printing, spraying, ink jetting, extrusion-die coating, flexographic printing, offset printing, gravure coating, knife coating, brushing, curtain coating, wire-wound rod coating, bar coating and the like. The ink receptive composition is typically applied directly to the substrate. Alternatively, the ink receptive composition may be coated onto a release liner and transfer coated onto the substrate.

After being coated, the ink receptive compositions are dried. The coated substrates are preferably dried at room temperature for at least 24 hours. Alternatively the coated substrates may be dried in a heated oven ranging in temperature from about 40° C. to about 70° C. for about 5 to about 20 minutes followed by room temperature drying for about 1 to 3 hours. For embodiments wherein a barrier layer is employed, it is preferred to employ a minimal thickness of ink receptive coating to minimize the drying time.

The imaged, polymeric sheets may be a finished product or an intermediate and are useful for a variety of articles including signage and commercial graphics films. Signage includes various retroreflective sheeting products for traffic control as well as non-retroreflective signage such as backlit signs.

The article is suitable for use as traffic signage, roll-up signs, flags, banners and other articles including other traffic warning items such as roll-up sheeting, cone wrap sheeting, post wrap sheeting, barrel wrap sheeting, license plate sheeting, barricade sheeting and sign sheeting; vehicle markings and segmented vehicle markings; pavement marking tapes and sheeting; as well as retroreflective tapes. The article is also useful in a wide variety of retroreflective safety devices including articles of clothing, construction work zone vests, life jackets, rainwear, logos, patches, promotional items, luggage, briefcases, book bags, backpacks, rafts, canes, umbrellas, animal collars, truck markings, trailer covers and curtains, etc.

Commercial graphic films include a variety of advertising, promotional, and corporate identity imaged films. The films typically comprise a pressure sensitive adhesive on the non-viewing surface in order that the films can be adhered to a target surface such as an automobile, truck, airplane, billboard, building, awning, window, floor, etc. Alternatively, imaged films lacking an adhesive are suitable for use as a banner, etc. that may be mechanically attached to a building, for example, in order to display. The films in combination with any associated adhesive and/or line range in thickness from about 5 mils (0.127 mm) to as thick as can be accommodated by the printer (e.g. ink jet printer).

The ink receptive layer exhibits good adhesion to the printed image such that the ink receptive layer exhibits at least 50% adhesion and preferably at least 80% adhesion as measured according to ASTM D 3359-95A. Preferred ink receptive compositions also exhibit sufficient adhesion to the substrate. The adhesion to the substrate can be evaluated in the same manner. In the case of poor adhesion to the substrate, both the ink and ink receptive layer are removed from the substrate, rather than merely the ink. For embodiments wherein the ink receptive composition exhibits good ink adhesion in combination with good substrate adhesion, additional bonding layers (e.g. tie layers, adhesive layers) are not required.

The ink jetted articles described herein are preferably "durable for outdoor usage" which refers to the ability of the article to withstand temperature extremes, exposure to moisture ranging from dew to rainstorms, and colorfast stability under sunlight's ultraviolet radiation. The threshold of durability is dependent upon the conditions to which the article is likely to be exposed and thus can vary. At minimum, however, the articles of the present invention do not delaminate or deteriorate when submersed in ambient temperature (25° C.) water for 24 hours, nor when exposed to temperatures (wet or dry) ranging from about −40° C. to about 140° F. (60° C.).

The durability of commercial graphic films can be evaluated according to standard tests, such as ASTM D3424-98, Standard Test Methods for Evaluating the Lightfastness and Weatherability of Printed Matter and ASTM D2244-93 (2000), Standard Test Method for Calculation of Color Differences From Instrumentally Measured Color Coordinates. The commercial graphic films of the invention preferably exhibit less than a 20% change over the lifetime of the product. Commercial graphic films typically have a life span of 1 year, 3 years, 5 years, or 9 years depending on the end-use of the film.

In the case of signage for traffic control, the articles of the present invention are preferably sufficiently durable such that the articles are able to withstand at least one year and more preferably at least three years of weathering. This can be determined with ASTM D4956-99 Standard Specification of Retroreflective Sheeting for Traffic Control that describes the application-dependent minimum performance requirements, both initially and following accelerated outdoor weathering, of several types of retroreflective sheeting. Initially, the reflective substrate meets or exceeds the minimum coefficient of retroreflection. For Type I white sheetings ("engineering grade"), the minimum coefficient of retroreflection is 70 cd/fc/ft$^2$ at an observation angle of 0.2° and an entrance angle of −4°, whereas for Type III white sheetings ("high intensity") the minimum coefficient of retroreflection is 250 cd/fc/ft$^2$ at an observation angle of 0.2° and an entrance angle of −4°. In addition, minimum specifications for shrinkage, flexibility adhesion, impact resistance and gloss are preferably met. After accelerated outdoor weathering for 12, 24, or 36 months, depending on the sheeting type and application, the retroreflective sheeting preferably shows no appreciable cracking, scaling, pitting, blistering, edge lifting or curling, or more than 0.8 millimeters shrinkage or expansion following the specified testing period. Further, the weathered retroreflective articles preferably exhibit at least the minimum coefficient of retroreflection and colorfastness. For example, Type I "engineering grade" retroreflective sheeting intended for permanent signing applications retains at least 50% of the initial minimum coefficient of retroreflection after 24 months of outdoor weathering and Type III high intensity type retroreflective sheeting intended for permanent signing applications retains at least 80% of the initial minimum coefficient of retroreflection following 36 months of outdoor weathering in order to meet the specification. The coefficient of retroreflection values, both initially and following outdoor weathering, are typically about 50% lower in view on imaged retroreflective substrates.

Objects and advantages of the invention are further illustrated by the following examples, but the particular materials and amounts thereof recited in the examples, as well as other conditions and details, should not be construed to unduly limit the invention. All parts, percentages and ratios herein are by weight unless otherwise specified.

EXAMPLES

Examples 1–4 and 6 as follows comprise coating compositions and thus ink receptive layers comprising a blend of a polyurethane polymer and an acrylic resin. In Examples 1–3 and 6 the coated polymeric sheet is ink-jet printed with a solvent based ink, whereas in Example 4 a radiation curable ink is employed. Examples 5 and 7–9 exemplify coating compositions comprising a urethane acrylic copolymer. In Examples 5 and 8, the base polymer consists of solely the urethane acrylic copolymer alone, in Examples 7 the urethane acrylic copolymer is blended with an acrylic polymer and in Example 9 the urethane acrylic copolymer is blended with a polyurethane polymer. Example 10 exemplifies an ink jet receptive coating comprising a blend of polyurethanes

Example 1

A dispersion mixture was made by adding water (54 g) to isopropyl alcohol (30 g) and mixing. Then the NEOREZ R960 aqueous polyurethane dispersion (10 g) and the NEOCRYL A-612 aqueous acrylic polymer dispersion (5 g) were added to the water-alcohol mixture with stirring to give a dispersion mixture.

A solution was then made by dissolving in N-methylpyrrolidone (1.0 g) TINUVIN 1130 (0.05 g), TINUVIN 292 (0.05 g) and the UVITEX OB (0.005 g).

The solution was then added to the dispersion mixture with stirring to give a coating mixture. The final formulation of the coating mixture is shown in Table 2.

TABLE 2

| Material | Material Type | Supplier | Weight in formulation | % Solids |
|---|---|---|---|---|
| NEOREZ R960 | Aqueous polyurethane dispersion | Avecia Inc., Wilmington, MA | 10 | 64.5 |
| NEOCRYL A-612 | Aqueous acrylic emulsion | | 5 | 32.4 |
| Deionized water | Diluent | | 54 | 0 |
| Isopropyl alcohol | Solvent | | 30 | 0 |
| N-Methylpyrrolidone | Cosolvent | | 1 | 0 |
| TINUVIN ® 1130 | HALS* | Ciba | 0.05 | 1 |
| TINUVIN 292 | UV** absorber | Speciality Chemicals, | 0.05 | 1 |
| UVITEX ® OB | Fluorescing agent | Tarrytown, NY | 0.005 | 0.1 |
| XAMA 7 | Trifunctional aziridine crosslinker | Hoechst Celanese Corp., Somerville, N.J. | 0.025 | 0.5 |

*HALS- hindered amine light stabilizer
**UV - ultraviolet light

The coating mixture was coated onto a vinyl film commercially available from 3M under the trade designation "Controltac Plus Graphic Film 180-10" using a wire wrapped rod Mayer Rod #12 (available from RD Specialties, Inc., Webster, N.Y. as a size 12 laboratory coating rod) designed to provide a wet coating thickness of 27.4 microns (one mil) and dried for two minutes at 95° C. (203° F.).

The coated vinyl film was printed with an ink jet printer commercially available from Océ Wide Format Printing Systems, Eagan, Minn. under the trade designation "Océ Arizona 30 Piezo Ink Jet printer" equipped with solvent-based ink jet inks commercially available from 3M under the trade designation "3M Piezo Ink Jet Ink Series 6700" using a 200% solid green test pattern (100% cyan and 100% yellow) as well as with a 6-color test pattern images containing area ranging from 0 to 400% coverage.

The sample was visually inspected and found to exhibit good image quality, no inter-color bleed and no mottle defects.

three different curing conditions. In-line cure indicates that the printed ink is cured within a second from printing. Delayed in-line indicates that the printed ink is cured after a delay of approximately 2 seconds to allow the ink to flow. Off-line cure indicates that the printed image is taken off-line to cure usually after about 2 minutes from printing the ink. The delayed in-line cure is representative of commercially available UV ink jet printers.

The results of the evaluation are as follows:

| Substrate | Method of cure | Magenta Color Density Dm | Dot diameter (microns) | Comments on Image Quality |
|---|---|---|---|---|
| Comparative Example - No Ink Receptive Layer | In-line | 0.793 | 120 | Perfectly round dots, some coalescence and banding. |
| | Delayed in-line | 0.834 | 132 | Somewhat round dots, banding |
| 180- 10 | Off-line | 0.972 | 152 | Irregular dots. Some banding. Severe mottle |
| 180-10 Coated as Described in Example 1 | In-line | 1.13 | 112 | Perfectly round dots. Excellent solid fill and color density. |
| | Delayed in-line | 1.19 | 201 | Perfectly round dots. Same as above but with increased gloss |
| | Off-line | 1.32 | 340 | Very large and round dots. Glossy image. Too much dot gain |

Example 2

Example 1 was repeated except that "NeoRez R-966" was substituted for "NeoRez R960." The sample was visually inspected and found to exhibit good image quality, no inter-color bleed and no mottle defects.

Example 3

Example 1 was repeated except that the ratio of "NeoRez R-960" to "NeoCryl A-612" was 55/45 rather than 2/1. The sample was visually inspected and found to exhibit good image quality, no inter-color bleed and no mottle defects.

Example 4

The coating composition of Example 1 was coated onto the vinyl film as described in Example 1. A radiation curable ink was ink jet printed with Ink Composition 2 employing the Xaar Jet XJ128-200 printheads with an x-Y translation stage at room temperature as described in WO02/085638. Off-line curing was achieved using either the Fusion Systems UV Processor, equipped with the indicated bulb commercially available from Fusion Systems Inc., Gaithersburg, Md. or the RPC UV Processor, equipped with two 30.5 cm medium pressure mercury bulbs, commercially available from RPC Industries, Plainfield, Ill. The in-line and delayed in-line curing was accomplished with an EFOS ULTRA-CURE 100SS Plus lamp was also used to achieve immediate partial cure of the ink. With this method, ultraviolet ("UV") light from the EFOS unit lamp was delivered via a gel-filled flexible connection to a location adjacent the printhead. In this configuration, the elapsed time between printing and curing was a fraction of a second. The output of the light was not sufficient for complete cure. Therefore, cure was completed off-line using the Fusion Systems UV Processor.

A comparative example was made by ink jet printing the same radiation curable ink in the same manner onto the same vinyl film in the absence of an ink receptive coating. The Example and Comparative Example were evaluated using The results show that the image quality was improved and defect free under all curing conditions as a result of providing the ink receptive layer on the surface of the 180-10 substrate.

Example 5

An aliphatic urethane acrylic copolymer commercially available from Neoresins Inc., Wilmington, Mass. under the trade designation "NeoPac R-9000" was coated onto white oriented polypropylene film commercially available from Nan Ya Corporation under the trade designation "XL80B" using a #14 Meyer rod. The coated sample was dried in a forced air oven for 10 minutes at 150° F.

A 12"×12" sample of the dried coating was laminated to a transfer adhesive and the assembly was laminated to a roll of "180-10" film that acts as a carrier film for carrying the sample through the printer. The carrier roll containing the 12"×12" sample was printed with an ink jet printer commercially available from Océ Wide Format Printing Systems, Eagan, Minn. under the trade designation "Océ Arizona 180 Piezo Ink Jet printer" equipped with solvent-based ink jet inks commercially available from 3M under the trade designation "3M Piezo Ink Jet Ink Series 6700" using a 200% solid green test pattern (100% cyan and 100% yellow) as well as with a 6-color test pattern images containing area ranging from 0 to 400% coverage.

The resultant image was visually inspected and determined to have very good color density and edge definition.

Example 6

A 80/20 solution was prepared from an aliphatic urethane dispersion commercially available from Neoresins under the trade designation NeoRez R-600 with NeoCryl A-612 by mixing 800 g of NeoRez R-600 with 200 g of NeoCryl A-612. The resulting solution was cut 50% with a 50/50 blend of DI water/IPA. The percent solids of the resulting solution was determined by taking a small sample of the solution (4–5 g) and evaporating the solvents by placing the sample in a 150° F. oven overnight. The percent solids were measured to be 16.4%.

Next, the Uvitex OB dye (i.e. of Example 1) was first made as a master batch by blending 1 g of dye in 99 g m-pyrol. After dispersing the dye in the m-pyrol, this solution was further diluted from 1% solids to 0.1% solids by taking 10 g of the 1% dye solution and blending with 90 g of IPA to produce a 0.1% dye solution. This dye solution was added to the polyurethane/acrylic mixture at 0.01% weight-% solids.

A roll (12 inches wide by 500 yards) of a film commercially available from Pliant Corporation, Schaumburg, Ill. under the trade designation "XP-6427A" was mounted on a Hirano Coater Model M-200L made by Harino Tecseed Co. LTD, Nara, Japan such that a coating could be applied to the shinny side of the film. The XP-6427A film comprises a core layer comprising a propylene/ethylene copolymer that contains titanium dioxide and an ethylene vinyl acetate (EVA) skin layer on both sides.

Using a ruling mill gravure cylinder having a volume factor of 36.2 cubic billion microns per square inch the shinny side of the film was reverse gravure coated with the R600/A-612 blend. The machine was set up for a line speed of 10 mpm and the drying oven was set at 85° C. The gravure speed was set at a speed of 8 mpm. Thus the gravure roll ratio is said to be 10 to 8 providing a ink receptive layer having a thickness of approximately 8 microns.

Example 7

Using similar procedures as Example 6 5% solution of an 80/20 solution was prepared from an aliphatic urethane acrylic copolymer commercially available from Neoresins under the trade designation of NeoPacR9000 with NeoCryl A-612. The concentrated blend was diluted to 5% solids by using a 70/30 blend of DI water/IPA.

Next, using the same set up as Example 6 the film was run through the Hirano Coater a second time using the 5% solids R9000/A-612 blend. The speed was set at 15 mpm and the oven was kept at 85° C. The gravure speed as set at 5 mpm. Thus, the roll ratio for this second coating was said to be 15 to 5.

The coated substrate from Examples 6 and 7 were then ink jet printed. In the same manner as Example 5. The printed samples were visually inspected and determined to have good image density and free of print defects.

Example 8

A second roll of film was coated using similar procedures as Example 7 except that NeoPac R9000 without any dilution or dye was employed. The line speed was set at 10 mpm, oven was set at 85C, and the gravure roll was set at 10 mpm. Thus the roll ratio is said to be 10 to 10 or actually 1 to 1.

Example 9

A 50/50 solution of "NeoRez R-9637" and "NeoPacR9000" having 35% solids was coated onto 180-10 with a Mayer Rod #10. The coated sample was ink jet printed in the same manner as described in Example 5 and found to have comparable image quality to Example 1.

Example 10

A 90/10 solution of NeoRez R-960 and NeoRez R-989 was coated onto a polypropylene film commercially available from Mitsubishi Chemical MKV Company, Japan under the trade designation "#WT001". A notch bar coated was employed to provide a coating having a dried thickness of 14 microns. The coating was dried at 65° C. for 5 minutes followed by 85° C. for 2 minutes. The coated substrate was ink jetted using VUTEK imaging. The imaged were inspected and found to have better image quality than the a composition employing NeoCryl A-612 in place of the NeoRez R-989 at the same concentrations.

What is claimed is:

1. An imaged article comprising:

a substrate comprising an ink receptive layer comprising a base polymer selected from the group comprising a) a urethane acrylic copolymer, b) a blend of at least one polyurethane polymer and at least one acrylic polymer, c) a blend of at least two polyurethane polymers, and mixtures thereof, wherein the polyurethane polymer has an elongation of at least 100% and the ink receptive layer is substantially free of filler; and a non-aqueous ink jetted image on the ink receptive layer.

2. The article of claim 1 wherein the ink receptive layer comprises about 10 wt-% to about 50 wt-% of the acrylic polymer.

3. The article of claim 1 wherein the ink receptive layer comprises about 25 wt-% to about 35 wt-% of the acrylic polymer.

4. The article of claim 1 wherein ink receptive layer comprises about 50 wt-% to about 90 wt-% of the polyurethane polymer.

5. The article of claim 1 wherein ink receptive layer comprises about 65 wt-% to about 75 wt-% of the polyurethane polymer.

6. The article of claim 2 wherein the composition further comprises and from about 0.2 wt-% to about 4 wt-% of a crosslinking agent.

7. The article of claim 1 wherein the urethane acrylic copolymer is further blended with at least one polyurethane polymer, acrylic polymer, or mixture thereof.

8. An imaged article comprising:

a substrate comprising an ink receptive layer comprising a base polymer selected from the group comprising a) a urethane acrylic copolymer, b) a blend of at least one polyurethane polymer and at least one acrylic polymer, c) a blend of at least two polyurethane polymers, and mixtures thereof, wherein the polyurethane polymer has an impart resistance of at least 100 in-lb and the ink receptive layer is substantially free of filler; and a non-aqueous ink jetted image on the ink receptive layer.

9. The article of claim 8 wherein the polyurethane polymer has an impart resistance of at least 150 in-lb.

10. The article of claim 1 wherein the polyurethane polymer has an elongation of at least 150%.

11. The article of claim 1 wherein the polyurethane polymer has an elongation of at least 200%.

12. An imaged article comprising:

a substrate comprising an ink receptive layer comprising a base polymer selected from the group comprising a) a urethane acrylic copolymer, b) a blend of at least one polyurethane polymer and at least one acrylic polymer, c) a blend of at least two polyurethane polymers, and mixtures thereof, wherein the polyurethane polymer has a tensile strength and 100% modulus of at least 3000 psi and the ink receptive layer is substantially free of filler; and a non-aqueous ink jetted image on the ink receptive layer.

13. The article of claim 1 wherein the substrate is a polymeric sheet material comprising at least one of an acrylic-containing film, a poly(vinyl chloride)-containing film, a poly(vinyl fluoride)-containing film, a urethane-containing film, a melamine-containing film, a polyvinyl butyral-containing film, a polyolefin-containing film, a polyester-containing film and a polycarbonate-containing film.

14. The article of claim 13 wherein the substrate is selected from an acrylic-containing film, a poly(vinyl chloride)-containing film, and a polyolefin-containing film.

15. The article of claim 13 wherein the sheet comprises a retroreflective viewing surface.

16. The article of claim 1 wherein the ink layer exhibits an improvement in overall image quality in comparison to the same image ink jetted on the same substrate, said substrate being substantially free of an ink receptive coating layer.

17. The article of claim 16 wherein the ink layer has a black color density of at least about 1.5.

18. The article of claim 16 wherein the ink layer has an ink dot diameter of at least $[(2)^{1/2}]$/dpi wherein dpi in the print resolution is dots per linear inch.

19. The article of claim 1 wherein the ink receptive layer comprises at least one colorant.

20. Signage comprising the article of claim 1.

21. A commercial graphic film comprising the article of claim 1.

* * * * *